US006343534B1

(12) United States Patent
Khanna et al.

(10) Patent No.: US 6,343,534 B1
(45) Date of Patent: Feb. 5, 2002

(54) LANDMINE DETECTOR WITH A HIGH-POWER MICROWAVE ILLUMINATOR AND AN INFRARED DETECTOR

(75) Inventors: Shyam M. Khanna, Ottawa; Francois Paquet, Nepean; Rene G. Apps, Dunrobin; Joseph S. Seregelyi, Stittsville, all of (CA)

(73) Assignee: Her Majesty the Queen in right of Canada, as represented by the Minister of National Defence, Ottawa (CA)

( * ) Notice: Subject to any disclaimer, the term of this patent is extended or adjusted under 35 U.S.C. 154(b) by 0 days.

(21) Appl. No.: 09/414,062

(22) Filed: Oct. 7, 1999

Related U.S. Application Data

(60) Provisional application No. 60/103,488, filed on Oct. 8, 1998.

(51) Int. Cl.[7] ..... F41F 3/04

(52) U.S. Cl. ..... 89/1.13; 102/402; 324/326; 324/329

(58) Field of Search ..... 89/1.13; 102/402; 324/326, 329

(56) References Cited

U.S. PATENT DOCUMENTS 5,869,967 A * 2/1999 Straus ..... 89/1.13
5,886,664 A * 3/1999 Yujiri et al. ..... 89/1.13

OTHER PUBLICATIONS

U.S. application No. 09/054,397, McFee et al., filed Apr. 3, 1998.

Li Et Al, "Infrared imaging of buried objects by thermal step–function excitations", Applied Optics, vol. 34, No. 25, Sep. 1, 1995, pp 5809–5816.

Simard, "Theoretical and experimental characterizations of the IR technology for the detection of low–metal and nonmetallic buried landmines", DREV–R–9615, Mar. 1997, pp. i–A6.

Khanna Et Al., "New hybrid remote sensing method using HPM illumination/IR detection for mine detection", Proceedings of SPIE Conference 3392 (Aerospace 98), Apr. 1998, pp. 1111–1121.

Carter Et Al, "Moisture and landmine detection", Proc. Of the Conference on Detection of Abandoned Landmines, IEE conference Publiction No. 431, Oct. 7–9, 1996, pp. 83–87.

Seregelyi Et Al., "Microwave heating of soil", Defence Research Establishment Ottawa Report 1331, Feb., 1998, pp iii–35.

(List continued on next page.)

*Primary Examiner*—J. Woodrow Eldred
(74) *Attorney, Agent, or Firm*—Larson & Taylor, PLC

(57) ABSTRACT

A hybrid remote-sensing apparatus is based on an active high-power microwave (HPM) illuminator and a passive infrared (IR) detector for the detection of shallow buried landmines. A 2.45 GHz, 5 kW microwave source is used for illumination and the thermal signature at the soil surface is detected in the 8–12 $\mu$m region both in near real-time as well as after a brief time-delay following illumination. The thermal signature at the soil surface is primarily made up of two components. A thermal signature occurs at the soil surface in near real-time due to the interference of the incident beam and the beam reflected by buried mines. A second thermal signature is generated when temperature contrasts due to differential microwave absorption by a mine and the surrounding soil are conducted upwards from that mine location to the surface. Both signatures are dependent on the complex dielectric constants of mines and the soil. These signatures can be used to determine the location of different types of metallic and non-metallic mine surrogates, dummy mines without explosives and live mines with explosives.

20 Claims, 7 Drawing Sheets

OTHER PUBLICATIONS

Dimarzio Et Al., "Microwave–enhanced infrared thermography", SPIE Conference on Detection and Remediation Technologies for Mines and Minelike Targets Iii, vol. 3392, Apr. 1998, pp 1103–1109.

Kashyap Et Al, "Electromagnetic scattering by an object buried in soil", ANTEM Symposium on Antenna Technology and Applied Electromagnetics, Aug., 1998, pp 397–400.

Gibson, "Mine boggler", Popular Science, Jan., 1999, pp 70–73.

Dubey Et Al., "Detection and remediation technologies for mine and minelike targets IV", Proceedings of SPIE, vol. 3710, Apr. 1999, pp 154–166.

Dimarzio Et Al., "Microwave–enhanced infrared thermography", SPIE Conference on Detection and Remediation Technologies for Mines and Minelike Targets IV, Apr. 1999, pp 173–179.

* cited by examiner

LANDMINE DETECTOR WITH A HIGH-POWER MICROWAVE ILLUMINATOR AND AN INFRARED DETECTOR

This claims benefit of PROVISIONAL APPLICATION Ser. No. 60/103,488 filed Oct. 8, 1998.

FIELD OF THE INVENTION

The present invention relates, in general, to an apparatus and method for detecting landmines and, in particular, to an apparatus with an infrared detector to obtain thermal signatures of the soil surface where a buried landmine might exist and where the apparatus irradiates that soil surface with electromagnetic energy and thermal signatures of that surface are obtained by the detector.

BACKGROUND OF THE INVENTION

It has been estimated that there are about 110 million anti-personnel (AP) and anti-tank (AT) mines scattered on the ground surface or buried in the ground in about 64 countries. These mines pose a serious threat to any military operation including UN peace-keeping operation and also to unsuspecting civilian populations. In addition, the effect on the local economy is often devastating, as is the case in Afghanistan, Bosnia etc. A mined area can never be safe until it is thoroughly cleared of mines.

The recent international treaty to ban the use of antipersonnel mines by most countries of the world has provided a significant push to eliminate these weapons from the arsenal of mankind and a welcome support to the cause of demining. Unfortunately, modern mines contain very little metal and are difficult to detect using conventional electromagnetic techniques. As a result, there are currently about 20 methods for mine detection at various stages of development. They range from quite simple methods such as the use of dogs to the most sophisticated modern techniques including the use of nuclear quadrupole resonance, thermal neutron activation, acoustic techniques, magnetic measurements using superconducting quantum interference devices (SQUIDs), and chemical detection methods.

For military as well as civilian/humanitarian applications, a successful mine detection method should be inexpensive, easy to use, and should have a fast and accurate detection rate. Further, any new detection method should have superior detection sensitivity, detection rate and a lower false alarm rate than that already available through existing methods. The method should also be forward-looking to avoid the risk of straddling the mine during detection.

Amongst the various detection methods under development, passive infrared (IR) imaging, conventional electromagnetic methods, ground probing radar (GPR), and thermal neutron activation (TNA) are perhaps the most promising techniques. Hyper-spectral imaging is also expected to yield a powerful method for mine detection. While these methods also have their respective limitations, a fusion of data from these sensors could provide a system that may be acceptable for most applications. This fusion of data concept is described in U.S. patent application Ser. No. 09/054,397 filed on Apr. 3, 1998 by John E. McFee et al for a Multisensor Vehicle—Mounted Mine Detector. Amongst these methods, passive IR imaging is particularly attractive due to the simplicity of the technique, remote-sensing capability and relatively lower cost as compared to the other methods. This method has its own problems. In this technique, the mine signature is strongly dependent on the diurnal variations in solar illumination, type of soil, soil moisture content, and temperature gradient in the soil. A mine signature may be almost non-existent under cloudy conditions. Active infrared methods have been proposed for mine detection. These methods typically require the use of a scanning laser system and reflections from the mines (on the ground surface) could provide information on the location of the mines. Recently, P. Li et al in "Infrared imaging of buried objects by thermal step-function excitations", Appl. Optics, 34, pages 5809–5816, 1995, obtained results which indicate the possibility of imaging surface and buried mines through the use of thermal step function excitation using infrared heating lamps. In these hybrid sensing systems, the detection and illumination wavelengths regions are not too different in wavelength and the illumination wavelengths provide a limited penetration of the incident radiation to the depth of the mines. Limited target signature, background clutter and false alarms under various experimental conditions are the principal problems in these methods.

SUMMARY OF THE INVENTION

It is an object of the present invention to provide a landmine detection apparatus that improves on existing hybrid sensing systems by obtaining clearer infrared target signatures resulting in reduced detrimental effects of background clutter and the creation of false alarms.

A landmine detector, according to one embodiment of the invention, comprises a vehicle on which a waveguide with an antenna is mounted and having a high-power microwave source coupled to the waveguide wherein the antenna is positioned above a ground surface over which the vehicle may travel at a distance such that an output from the antenna can irradiate the ground surface, an infrared camera being mounted on the vehicle and positioned to obtain thermal signatures of the ground surface where an output of the antenna is directed when that surface is irradiated with microwave energy from said antenna, the thermal signatures providing indications as to the possible presence of any landmines buried in that area over which the antenna was positioned.

BRIEF DESCRIPTION OF THE DRAWINGS

The invention will now be described in more detail with reference to the accompanying drawings, in which.

DESCRIPTION OF THE PREFERRED EMBODIMENTS

Passive IR imaging technique for mine detection is described by J.-R. Simard in "Theoretical and experimental characterizations of the IR technology for the detection of low-metal and non-metallic buried landmines", DREV-R 9615, Defence Research Establishment Valcartier, Quebec, Canada, March 1997, and gives a clear description of the processes involved in passive IR imaging of buried mines. As described by Simard, these processes lead to different soil surface temperatures, $T_m$ and $T_r$, above the mine and at a near-by soil surface reference site without a mine, respectively. Assuming a one dimensional conduction process, these temperatures can be determined by solving the differential heat equation for the three zones a, b and c shown in FIG. 1*a* which illustrates in cross-section a landmine buried in the ground.

The differential heat equation for different zones $$\frac{\partial T}{\partial t} = K_T \frac{\partial^2 T}{\partial x^2}. \tag{1}$$

Figure 1B:
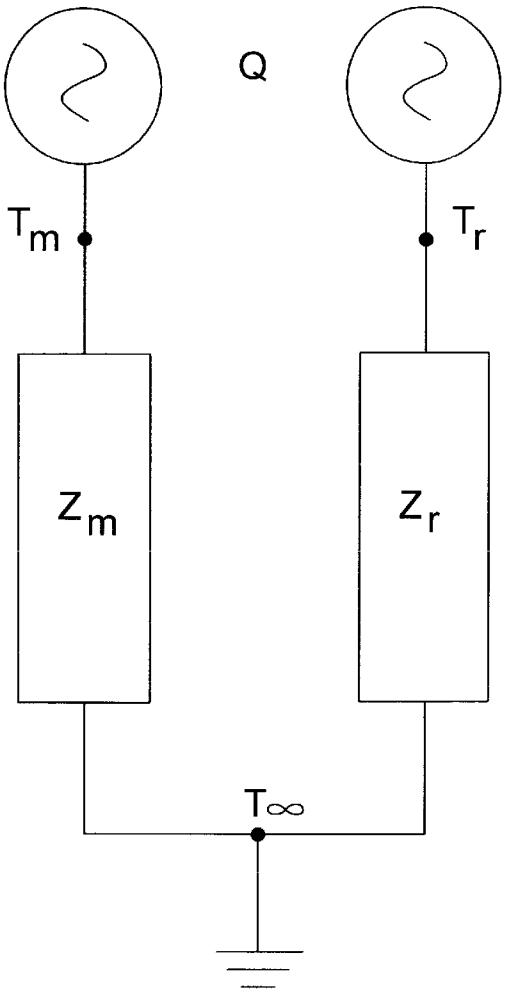
FIG. 1*b* is a schematic diagram to explain the passive infrared imaging method using a constant heat flow and different heat impedances at the mine and reference (no mine) sites.
Figure 1A:
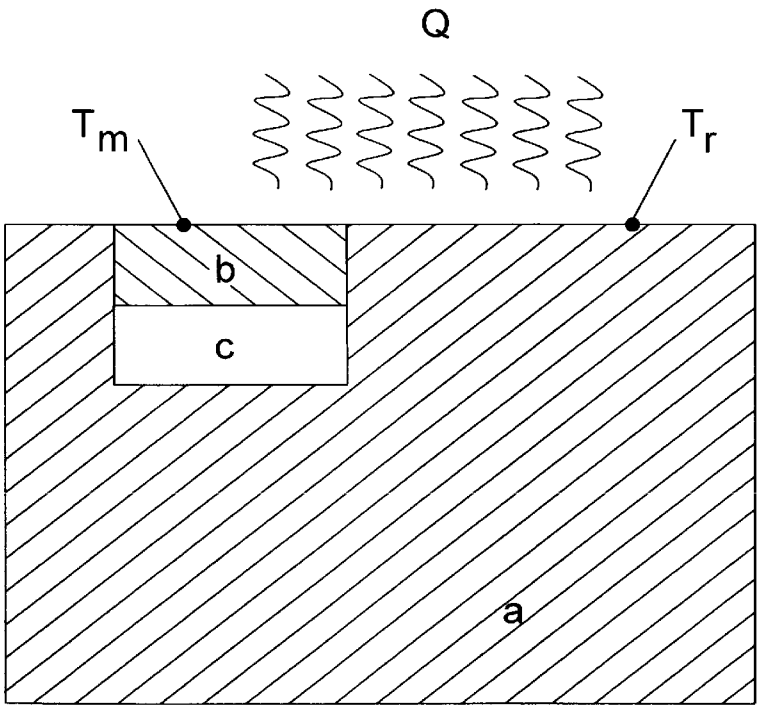
FIG. 1*a* is a schematic diagram illustrating in cross section a buried landmine in the ground.

In this equation, T is the temperature, t is time, x is depth in the soil and $K_T$ is thermal heat diffusivity. It is assumed that the soil surface is illuminated uniformly and there is uniform heat flow Q from the atmosphere into the ground surface above the mine and the surface surrounding the mine. J.-R. Simard in "Theoretical and experimental characterizations of the IR technology for the detection of low-metal and non-metallic buried landmines", DREV-R 9615, Defence Research Establishment Valcartier, Quebec, Canada, March 1997, has discussed a simplified model for the above process. The soil column above the mine and an equivalent soil column in a reference region with no mine have different heat impedances, $Z_m$ and $Z_r$ respectively, as shown in FIG. 1*b*. In FIG. 1*b*, $T\infty$ is the temperature deep beneath the surface with $T_m$ being the surface temperature above a buried mine and $T_r$ being the surface temperature above a reference (no mine) site. A uniform heat flow Q is assumed from the atmosphere into these two adjacent regions. This would lead to different soil surface temperatures $T_m$ and $T_r$ above the mine and in the reference (no mine) region. $(T_m-T_r)$ gives the target thermal signature which is observed by thermal imaging. Clearly $(T_m-T_r)$ is proportional to Q and also to $(Z_m-Z_r)$.

It is, therefore, the difference in heat conductivity of the mine and the soil surrounding it at the mine level that leads to a temperature contrast at the soil surface above the mine. Consider an initial state with a buried target at the same temperature as its surrounding soil and no initial temperature contrast at the surface. The onset of uniform heat flow Q from the atmosphere to the ground leads to a temperature contrast between the mine and soil surrounding it at the mine level due to different heat impedance's $Z_m$ and $Z_r$ as discussed above. There is a time delay between the onset of heat flow at the soil surface and the development of the temperature contrast at the mine level. This temperature contrast at the mine level is also accompanied with the development of a temperature contrast at the soil surface above the mine and the reference (no mine) region. Enhanced surface heating through infrared radiation could increase this temperature contrast at the soil surface and decrease the time required, since the onset of heat flow Q, for the development of a minimum detectable temperature difference at the soil surface. However, infrared radiation cannot penetrate into the soil and is absorbed at the surface. As such, it cannot interact with the mine directly to yield a temperature contrast at the mine level. Enhanced surface heating interacts with the mine only indirectly through the thermal conduction process.

In contrast, microwaves penetrate a relatively long distance into the ground depending on the soil moisture content and interact directly with a mine buried near the surface and the soil surrounding it. The complex dielectric constant of a mine and the soil surrounding it are, in general, different. As a result, when a mined area is illuminated with microwave radiation, a temperature variation at the soil surface above a mine, relative to the near-by soil surface, can be observed. This temperature contrast can be detected with an infrared imaging system and may be exploited for mine detection. The phenomenon of interaction of microwave radiation with a buried mine and the soil surrounding it is, however, quite complex and will be discussed later.

The effect of this direct interaction of the microwave radiation with the mine can lead to a temperature contrast at the soil surface in a shorter time period than in an active IR (enhanced surface heating) imaging system. This mine detection method is described in an article by S. M. Khanna et al entitled "New hybrid remote sensing method using HPM illumination/IR detection for mine detection" which was published in the Proceedings of SPIE Conference 3392 (Aerosense '98) on Detection and Remediation Technologies for Mines and Minelike Targets III in April 1998 and which is incorporated herein by reference.

When an electromagnetic wave travels from media 1 to media 2, a part of the incident radiation is reflected and the balance is transmitted into media 2. For normal incidence, the reflection coefficient $\Gamma\|$ for parallel polarization electric field is given by $$\Gamma_{\|} = \frac{\sqrt{\frac{\varepsilon_1^*}{\varepsilon_2^*} - 1}}{\sqrt{\frac{\varepsilon_1^*}{\varepsilon_2^*} + 1}} \tag{2}$$

$\in^*$ being the complex permittivity and the suffix corresponds to the media. Further, $$\in^* = \in' - j\in'' \tag{3}$$

where $\in'$ is the relative dielectric constant and $\in''$ is the loss factor of the media. The loss tangent is given by $$\tan\delta = \frac{\varepsilon''}{\varepsilon'}. \tag{4}$$

The electromagnetic wave traveling in a media is attenuated by a factor $e^{-2\alpha x}$ where x is the distance traveled in the media. The attenuation factor $\alpha$ is given by $$\alpha = \frac{\omega}{c}\left[\frac{\varepsilon'}{2}\left[\sqrt{1 + \left(\frac{\varepsilon''}{\varepsilon'}\right)} - 1\right]\right]^{\frac{1}{2}} \tag{5}$$

where $\omega$ is the angular frequency of the electromagnetic radiation and c is the velocity of light. The power loss P in dB/cm of the electromagnetic wave due to the passage in the media can be expressed as $$p = -0.0868\frac{\omega}{c}\left[\frac{\varepsilon'}{2}\left[\sqrt{1+\left(\frac{\varepsilon''}{\varepsilon'}\right)}-1\right]\right]^{\frac{1}{2}}. \quad (6)$$

The microwave power available for heating a sample buried at a depth x in the ground decreases exponentially with x and attenuation factor $\alpha$. The increase in the temperature of the sample depends on the microwave energy absorbed by the sample and varies inversely with the sample thermal heat capacity.

The propagation of microwaves in the soil and soil heating rates with microwaves have been studied by various workers. Both the permittivity, $\in'$, and loss factor, $\in''$, depend strongly on the moisture content of the soil, frequency of microwaves, and, to a lesser extent, the type of soil. In particular, at 2.45 GHz the loss factor $\in''$ of sand is quite low for dry sand and increases markedly with soil moisture content. Due to the difficulty in characterizing the soil type, it is best to measure the dielectric properties of soil under consideration as a function of moisture content at the desired microwave frequency. R. Von Hippel in "Dielectric Materials and Applications", pages 314–327, M.I.T. Press, August 1966, has given the dielectric properties at microwave frequencies of a variety of plastics and soils with different moisture contents.

The coupling of microwaves with the sample buried in the ground leads to a difference in temperature of the target and its surrounding soil, both at the target level and, after a time delay, at the soil surface level. At the same time, cooling mechanisms through conduction, radiation and convection set in to counter the development of these temperature contrasts.

There are two mechanisms which lead to a temperature contrast at the soil surface when microwaves interact with a buried mine. Considering the incident microwave energy transmitted into the soil at the soil/air interface, a portion will be absorbed by the soil as the microwave beam travels in the soil media from the air/soil interface to the soil/mine interface. A portion of the microwave beam incident on the mine will be reflected at the soil/mine interface. This reflected beam interferes with the incident beam in the region between the soil surface and the top of the mine. The heating effect of the resultant microwave field at the soil surface provides a signature of the buried mine. This thermal signature will occur almost simultaneously with the microwave irradiation. This signature will be dependent on the depth of the mine beneath the soil surface as this affects how the reflected wave interacts with the incident wave at the surface.

The second mechanism that leads to a thermal signature at the soil surface is due to the absorption of microwave energy by the mine. As discussed above, the buried mine and the soil surrounding it absorb microwave radiation at different rates depending on their dielectric properties. This leads to a mine that is either hot or cold compared to its surrounding soil. The temperature difference is thermally conducted upwards to the soil surface above the mine. This results in a thermal signature of the mine at the soil surface a short time after irradiation. The time evolution of the thermal signatures at the soil surface will be a superposition of these types of thermal signatures. Depending on the depth of mine, these two signatures are generally well separated in time. A clear understanding of the origin of these two types of thermal signatures is key for the use of a method according to the present invention.

Figure 2:
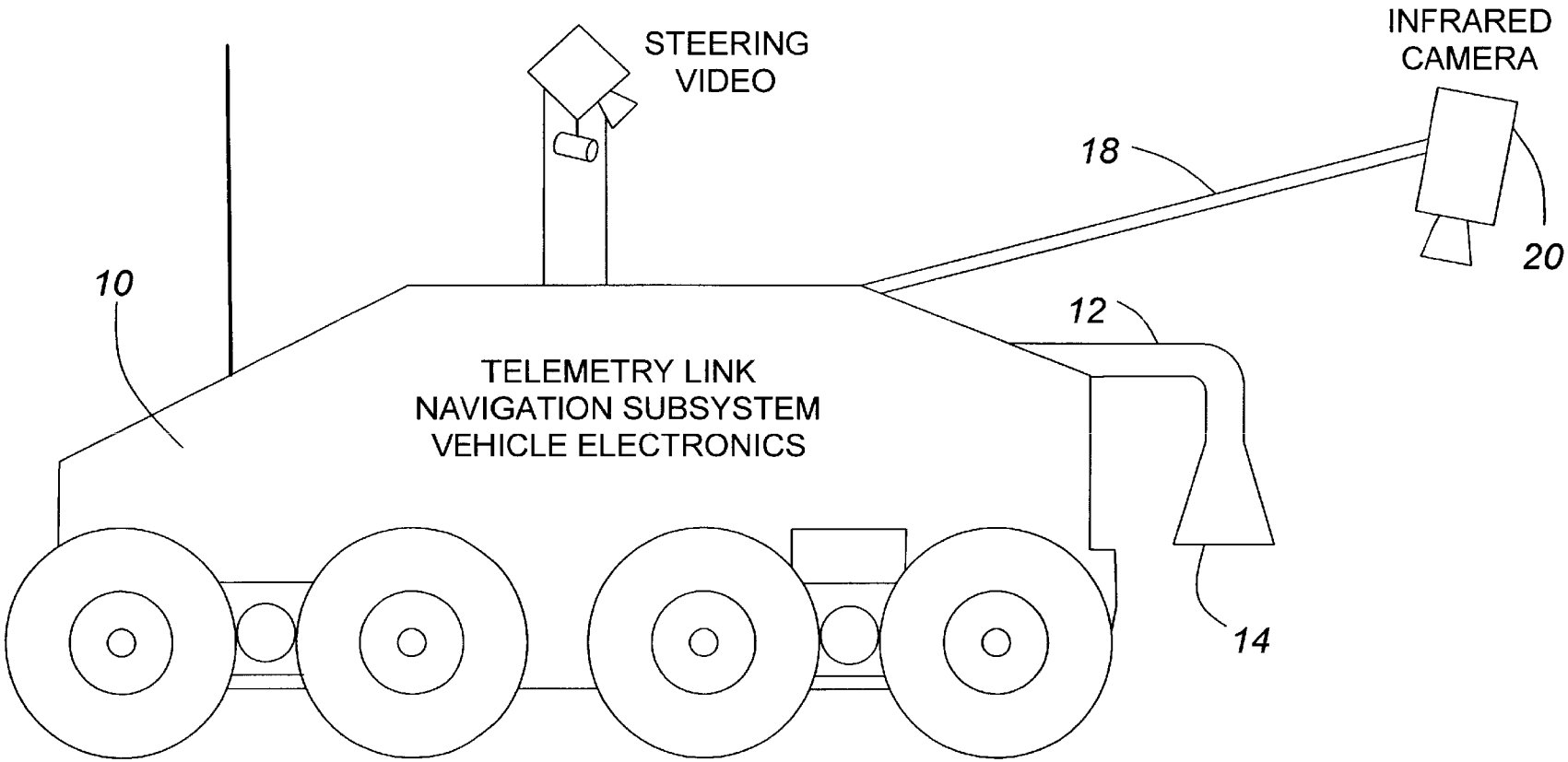
FIG. 2 is a schematic side view of a landmine detector vehicle according to the present invention.

FIG. 2 illustrates, in side view, a landmine detection vehicle 10 according to the present invention containing a microwave source coupled to a waveguide 12 and horn antenna 14 which are mounted on vehicle 10, the antenna 14 being vertically oriented as shown in FIG. 2 and being located at a position where it can irradiate the soil surface in front of the vehicle. The vehicle 10 carries an infrared (IR) camera 20 to obtain thermal signatures of the soil surface irradiated by the microwave source through the horn antenna.

A 5 kW magnetron operating at 2.45 GHz was used as a source in order to obtain accurate experimental data for a variety of scenarios under laboratory and field conditions. Uniform illumination with a collimated microwave beam would have been preferred but, for convenience, a waveguide (WR 284) with a standard gain horn antenna (EMCO 3160-03) was used instead to obtain a large cross-section beam. The targets were placed under the horn symmetric to its principal (vertical) axis. The horn to soil surface distance could be changed by adding sections of waveguide. Most of the work was done with a horn to soil surface distance of 56 cm, although data was also taken with distances ranging from 30 to 88 cm. The microwave power output at the magnetron was varied from 1 to 5 kW. Typical time of microwave illumination ranged from 1 to 3 min. The microwave power density at the soil surface was estimated to be 1 to 3 W/cm$^2$. An 8–12 $\mu$m infrared camera provided infrared imagery of the soil surface covering the target.

Non-metallic mine surrogates consisting of discs (7.5 to 10.0 cm dia, 2.5 cm thick) of delrin, low density polyethylene and phenolic plastic were used to obtain data and, in addition, dummy mines without explosives and live mines with explosives but without fuses were also studied. Three types of mines were used (PMA 1, PMA 2, and PMA 3) to obtain experimental data. The dimensions of these mines are: PMA 1: length 140 mm, width 70 mm, height 30 mm, mass 400 gm; PMA 2: diameter 68 mm, height 61 mm, mass 135 gm; PMA 3: diameter 111 mm, height 40 mm, mass 180 gm. All three mines are minimum metal AP mines.

The PMA 1 is rectangular in shape with a plastic body and a hinged top. The PMA 2 has a cylindrical plastic casing. The PMA 3 is cylindrical in shape and is covered by a black rubber gasket.

Dry and moist sand with moisture contents ranging from ~0 to 20% water content by mass was used for work in the laboratory. Laboratory experiments with mine surrogates and mines without explosives were also conducted with soil of low clay content and at various moisture levels. The depth of the top surface of the targets ranged from ~0.5 cm to 5 cm, although most of the work was done with depths of ~1 to 3 cm. In all laboratory experiments, special effort was made to ensure that the target and soil surrounding it were at the same temperature initially and in an equilibrium state before microwave illumination. In the early stages of these experiments, most of the work was done with non-metallic (and metallic) mine surrogates inside an anechoic chamber. A 3 ft. tall plastic barrel full of sand was placed under the horn. The mine surrogates were placed symmetrically under the horn at desired depths in the sand. Initially, it was not possible to take real-time IR imagery and about 60 sec elapsed between the cessation of microwave illumination and IR imaging. Automatic data acquisition was not possible with the camera initially and only Polaroid pictures were taken.

Figure 3:
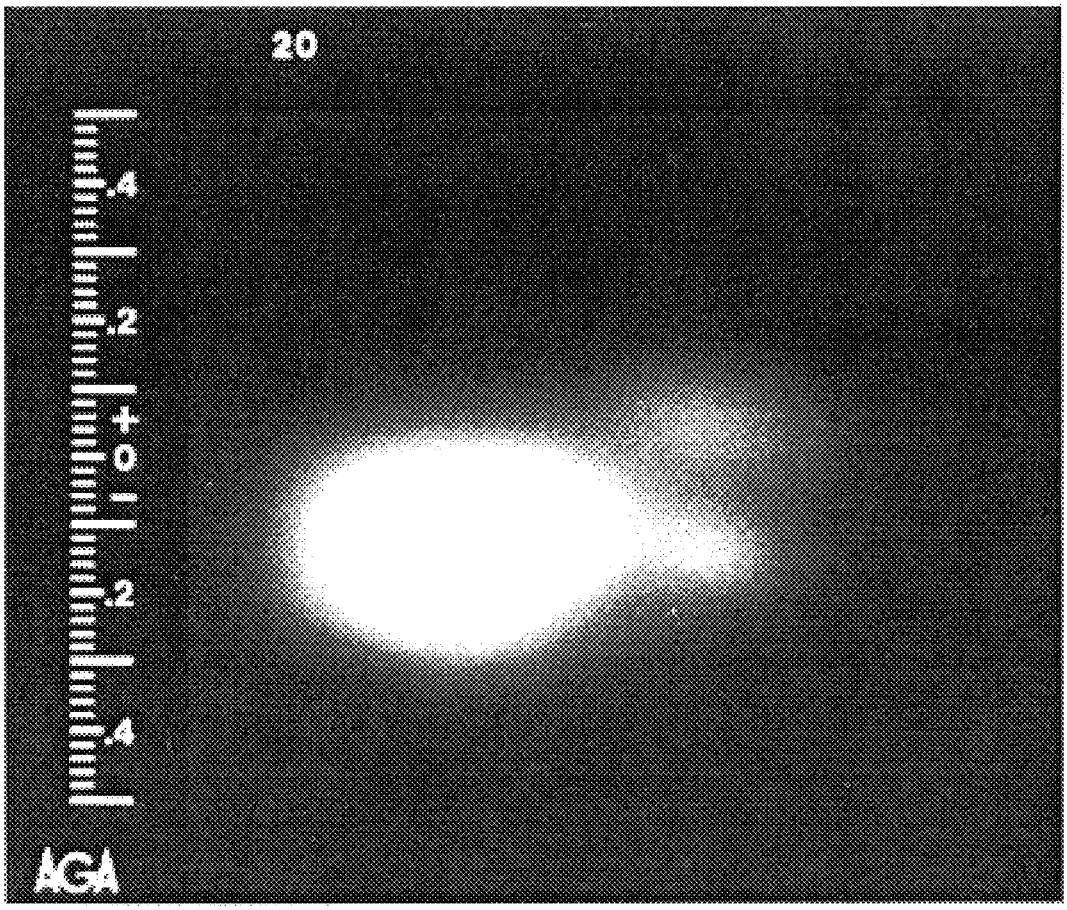
FIG. 3 is an IR picture of the sand surface above three mine surrogates buried in dry sand after being irradiated with high power microwave (HPM)

FIG. 3 shows an IR picture of three mine surrogates consisting of a square phenolic (bottom left, 10×10 cm, 2.5 cm thick, depth 1.1 cm), phenolic (bottom right 3.8 cm dia, 5 cm thick, depth 0.9 cm) and delrin (top right, 10 cm dia, 5 cm thick, 1.4 cm depth) discs buried in dry sand. The picture was taken 13 min. after irradiating the sand with high-power microwave (HPM) at 5 kW for 3 min. These IR signatures on the soil surface were due to the difference in microwave absorption by the mine surrogates and soil surrounding them at the mine level. The resulting temperature contrast at the mine level between the mines and the surrounding soil is conducted up to the soil surface and is recorded by the IR camera. In these IR pictures, hotter objects are shown in whiter shades and cooler objects in darker shades.

Figure 4A:
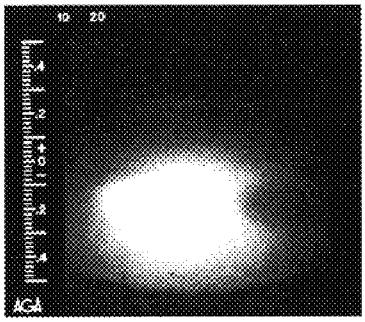
FIGS. 4*a*, 4*b* and 4*c* are IR pictures of soil surface showing the effects of reflection of microwave from two mine surrogates buried at different depths in moist sand.

Thermal effects at the soil surface due to reflection of microwaves from two mine surrogates buried in moist sand with 14% moisture content are shown in FIG. 4. A microwave power level of 5 kW was used for 1 min duration. In FIG. 4*a*, two identical mine surrogates (delrin disc dia: 10 cm, thickness 2.5 cm) were buried at different depths (left target: 1.6 cm, right target: 1.0 cm). The central region in these pictures is still hot due to the heating of the soil by HPM. Further, this heating is not uniform due to non-uniform HPM radiation from the horn antenna. The two targets appear in FIG. 4*a* as a hot spot on the left side and a cold spot on the right side against a general bright background. Although the two targets are of the same material, the path difference at the soil surface between the incident and reflected beams is different for these two targets due to the difference in their depths. This leads to a constructive interference at the surface for the left target and a destructive interference for the right target.

Figure 4B:
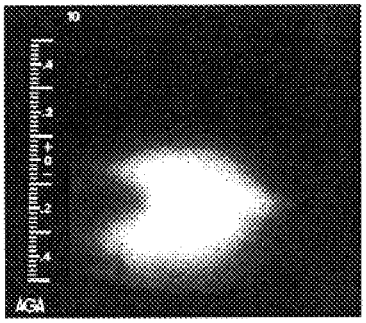

For confirmation of this explanation, the depth of these targets was changed in FIG. 4*b*. The new depths are: (left target: 0.9 cm, right target: 1.5 cm). Note that the left signature changed from a hot signature in FIG. 4*a* to a cold signature in FIG. 4*b*. Similarly, the right signature changed from a cold signature to a hot signature in these pictures.

Figure 4C:
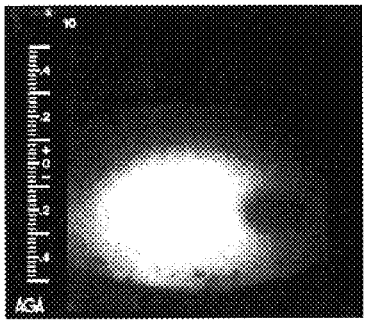

Additional confirmation of interference between the incident and reflected beams leading to thermal signature at the soil surface is given by the results shown in FIG. 4*c*. This figure depicts different thermal effects due to reflection of microwaves from two targets made of different materials which are buried at the same depth (~0.6 cm). The left target is an aluminum disc while the target at the right is a delrin disc. The aluminum target gives a hot signature while the delrin target gives a cold signature. The opposite polarity of the signatures from these two targets at the same depth is due to the phase reversal of the microwave field upon reflection at a metallic surface.

Optimal microwave interference patterns are obtained in a uniform soil media which are detectable through their thermal effects as was the case in FIGS. 4*a*–4*c*. In a non-uniform media, random scattering of the microwaves would tend to scatter the reflected signal from the target and degrade the interference pattern to varying extents.

For real-time HPM/IR imaging and better controlled laboratory experiments, a 2 m×2 m×0.6 m deep pit was filled with the same construction sand as was used in the previous experiments. The moisture content of the sand immediately below the horn was varied for the experiments. For the majority of these experiments, an insulated wooden structure was constructed around the pit to minimize variations in the environment above the soil surface. Real-time IR imagery was acquired during and after HPM irradiation using an 8–12 $\mu$m Agema Thermovision 880 IR camera. Digital image processing of the IR imagery was done to obtain the target signatures.

FIG. 5 depicts IR pictures of a moist sand surface (moisture content: 7.7% by weight) covering 3 mine surrogates buried at different depths. The surrogates are delrin discs, 10 cm dia. and 2.5 cm thick. The depth of the targets: (Right bottom: 0.5 cm, Left bottom: 0.8 cm, Top: 1.0 cm). The targets were heated by HPM at 5 kW for 1.5 min. The horn to sand surface distance was 56 cm. IR pictures of moist sand surface were taken before, during and after HPM irradiation. The top portion in these pictures has not received any significant HPM radiation. In FIGS. 5*b* and 5*c*, the intensity has been compensated for non-uniform microwave illumination that results in a "hot" spot in the central portion. FIGS. 5*c* and 5*d* are the same with the exception that the central hot spot has been removed in FIG. 5*c*.

Figure 5A:
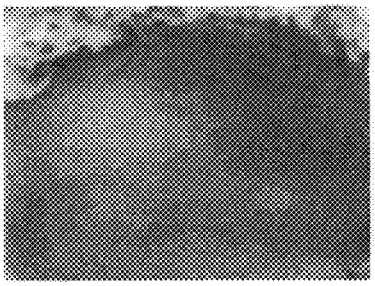
FIGS. 5*a*, 5*b*, 5*c* and 5*d* are IR pictures of the sand surface over mine surrogates buried in moist sand at different depths which were taken at different times before and after irradiation with HPM.
Figure 5B:
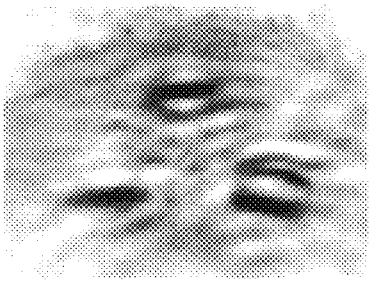
Figure 5C:
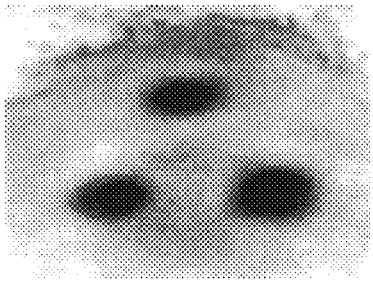
Figure 5D:
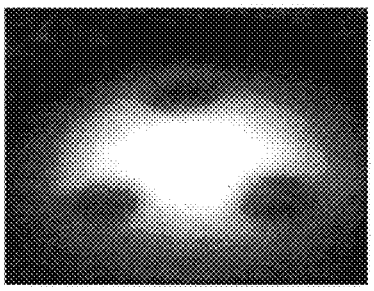

FIG. 5*a* shows almost no IR signature of the mine surrogates at the soil surface before HPM irradiation. The temperature range between the brightest to darkest part of the image in 5*a* was 1.7° C. FIG. 5*b* shows the IR signatures at the surface due to reflections from the mine surrogate taken 2 minutes after irradiation. The three mine surrogates could be seen clearly in FIG. 5*b*, although the pattern of reflection does not show the complete target. The temperature range between the brightest to darkest portions of the image in FIG. 5*b* was 5.4° C. FIG. 5*c* gives very clear thermal signatures on the sand surface for the three mine surrogates when taken after 5.5 minutes after irradiation. FIG. 5*b* and 5*c* have been compensated for non-uniform HPM illumination. In FIG. 5*c*, the signatures are mainly due to the difference in microwave absorption by the targets and the sand at the target level surrounding the targets. This thermal contrast at the target level is then conducted upwards to the soil surface and appears at the soil surface sometime after HPM irradiation. The temperature range be tween the brightest to darkest portions in FIG. 5*c* was 3.9° C. It should be noted that the targets in FIGS. 5*c*, 5*d* appear colder than the background in contrast to the results shown for dry sand (FIG. 3). These results would be expected from a comparison of the loss factor of sand, moist sand, and these targets. FIG. 5*d* was taken 5.5 min after microwave radiation was turned off. It includes the effects due to non-uniform heating of the sand surface resulting from the microwave beam pattern under the horn which appears as a central hot spot. Although the targets are apparent in this figure, compensation for the non-uniform HPM irradiation significantly improves target detection capability as seen in FIG. 5*c*. The temperature at any point or average temperature for any small region in this picture could be determined. The temperature range in FIG. 5*d* between the brightest to darkest parts of the image was 7.7° C.

Extensive data was taken in the laboratory with other types of plastics targets and soils containing clay with varying moisture content. Data was also taken in the laboratory with PMA 1, PMA 2 and PMA 3 mines without explosives. PMA 1 was filled with paraffin to duplicate the microwave properties of explosives but that data is not included here. It should be stressed that almost in all cases, the targets were detectable after HPM irradiation through thermal signatures on the soil surface, either through the reflected signal from the mine, or the differential absorption by the mine as compared to the soil surrounding it or both.

Results of field trials conducted at the Defence Research Establishment Suffield (DRES), Canada in April 1997 are described next. PMA 1, PMA 2 and PMA 3 mines with explosives but without fuses were used. Using a trailer, a horn antenna could be moved directly over the mines buried in the ground. The magnetron and IR camera used to obtain the previously described experimental data were also used in these trials. Real-time IR imagery was collected before, during and after microwave irradiation.

The mines were buried in the ground four days prior to these experiments by personnel experienced in this work. There was no rain during this period. The climate was sunny, cold, windy and dry with an air temperature of 6° C. The PMA 1 and PMA 2 were buried in the ground from which turf was already removed. The size of loose disturbed soil without turf, covering each of these mines, was 22×22 cm. In addition, the PMA 2 and PMA 3 were buried in soil covered with turf which had dried out over the winter season. A 12×12 cm turf patch covered each of these mines.

Figure 6A:
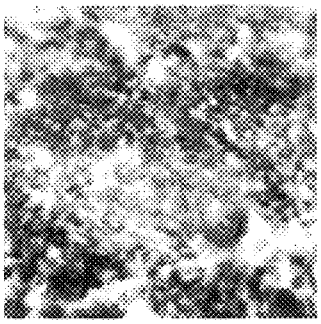
FIGS. 6*a*, 6*b* and 6*c* are IR pictures of loose soil covering a PMA 1 mine (with explosives) before and after irradiation with HPM.
Figure 6B:
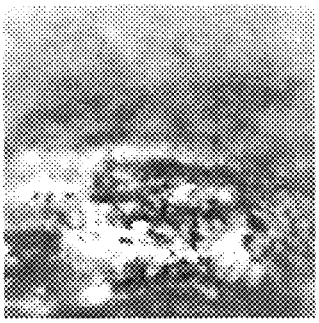
Figure 6C:
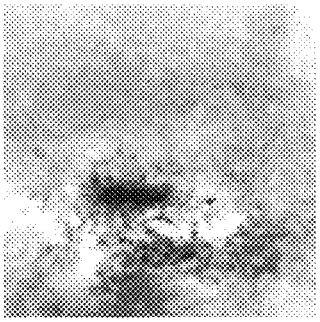

FIG. 6*a* is an IR picture before HPM irradiation of the loose soil surface, without any grass, covering the PMA 1 containing explosives, but without a fuse, buried at a depth of 1.5 cm. The loose soil patch is not distinguishable in the IR image before microwave irradiation. FIG. 6*b* depicts the thermal effect on the soil surface due to reflection from the mine after 3 min from the start of HPM irradiation at 5 kW. This figure shows that the mine is not clearly distinguishable. However, enhanced thermal features on the surface, especially dark and bright bands over the mine region could be noted. In a similar experiment in the laboratory but with 6% moisture content, dark and bright bands or patches were seen over the mine region due to reflections from the mine. FIG. 6*c*, taken 20 min after irradiation for 5 min at 5 kW, depicts the thermal signature at the soil surface due to a difference in microwave absorption by the mine and the surrounding soil. PMA 1 is clearly distinguishable from the background in FIG. 6*c*.

Note that the loose soil covering the mine is not visible in IR before HPM irradiation (FIG. 6*a*), but can be more easily demarcated during and after HPM irradiation (FIGS. 6*b* and 6*c*). The square shape of this loose soil patch can also be identified.

Figure 7A:
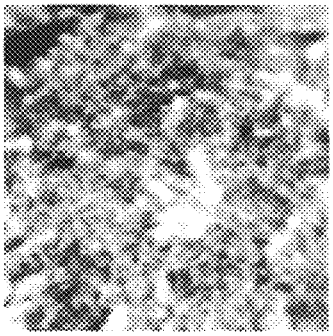
FIGS. 7*a*, 7*b* and 7*c* are IR pictures of soil turf covering a PMA 3 mine (with explosives) before and after irradiation with HPM.
Figure 7B:
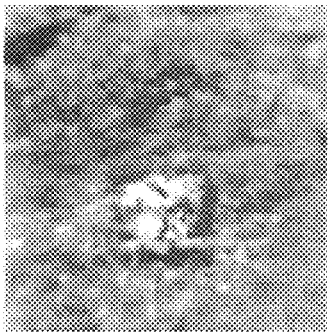
Figure 7C:
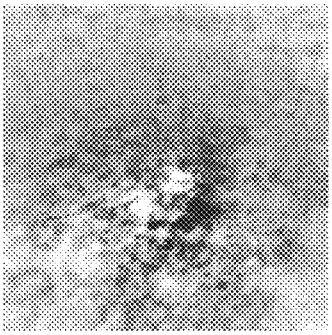

Similar results are shown for PMA 3 in FIGS. 7*a* to 7*c*. The mine is buried in a smaller patch of turf, 12×12 cm in size. FIG. 7*a* is an IR picture taken before HPM irradiation. Enhanced thermal structure, which may serve as a mine signature, can be seen over the mine location in FIG. 7*b* in a thermal signature taken 2.5 min from the start of HPM irradiation at 5 kW. Comparing FIGS. 7*a* and 7*b*, it is also clear that it is much easier to pinpoint the disturbed turf area used to bury the mine with this method than through passive IR imaging. The square shape of this cut turf piece can be identified. Compare the larger size of the disturbed area in FIG. 6*b* to that in FIG. 7*b*. For the PMA 3, a thermal signature, due to absorption of microwaves by the mine, is not seen. The effects due to reflection appear to mask the effects due to absorption. In contrast, thermal signals due to both the reflection and absorption by PMA 1, PMA 2 and PMA 3 were seen with mine depths ranging from 1 to 2 cm with a soil moisture content of ~6%.

These results confirm that the HPM/IR method can provide a powerful remote-sensing technique for mine detection. This method is complementary to passive IR mine detection techniques and can detect mines under cloudy and wet conditions. The mine signatures arise due to both reflection and absorption by the mine and appear as thermal signatures at the soil surface above the mine. The signature that arise due to reflection may be affected by a non-uniform surface but using signatures obtained by reflection and absorption can normally provide a clear indication of the presence of mines. The HPM/IR method can provide a pre-confirmatory method for precise location of a mine from a stand-off distance.

Various modifications may be made to the preferred embodiments without departing from the spirit and scope of the invention as defined in the appended claims. Although a microwave source at 2.45 Ghz was used to obtain the data described above due to that source being readily available, other sources may be used which range in frequency from 500 MHz to 10 GHz. A microwave source at 915 MHz is one being considered to obtain further data which would reduce the effects of surface reflection from rough surfaces due to the longer wavelength. A typical microwave power density of 1 to 3 W/cm$^2$ at the soil surface would normally be required with an illumination time that ranges from a few tens of seconds to a few hundreds of seconds. A lower time exposure would, obviously, be required at higher microwave power density obtainable from using higher power sources. In addition, although an IR camera that obtained images in the 8–12 $\mu$m range was used to obtain the experimental data, other types of IR cameras may also be used to obtain thermal images.

The embodiments of the invention in which an exclusive property or privilege is claimed are defined as follows:

1. A landmine detector comprising a vehicle on which a waveguide with a vertically oriented antenna is mounted and having a high-power microwave source coupled to the waveguide wherein the antenna is positioned above a ground surface over which the vehicle may travel at a distance such that an output from the antenna can irradiate that surface, an infrared camera being mounted on the vehicle and positioned to obtain thermal signatures of the ground surface where an output of the antenna is directed when that surface is irradiated with microwave energy from said antenna, the thermal signatures providing indications as to the possible presence of any landmines buried in that area over which the antenna was positioned.

2. A landmine detector as defined in claim 1, wherein the antenna is positioned above the ground surface at a distance that its output can irradiate that surface with a power density in the range of 1 to 3 W/cm$^2$.

3. A landmine detector as defined in claim 2 wherein the microwave source is operable at a power of from 1 to 5 kW.

4. A landmine defector as defined in claim 3 wherein the microwave source's output is at 2.45 GHz.

5. A landmine detector as defined in claim 4 wherein the infrared camera is one that obtains thermal signatures in the 8–12 $\mu$m range.

6. A landmine detector as defined in claim 1 wherein the infrared camera is one that obtains thermal signatures in the 8–12 $\mu$m range.

7. A landmine detector as defined in claim 2 wherein the infrared camera is one that obtains thermal signatures in the 8–12 $\mu$m range.

8. A landmine detector as defined in claim 3 wherein the infrared camera is one that obtains thermal signatures in the 8–12 $\mu$m range.

9. A landmine detector as defined in claim 1 wherein the height of the antenna above the ground surface is adjustable.

10. A landmine detector as defined in claim 9 wherein the microwave source is operable at a variable power level up to 5 kW.

11. A landmine detector as defined in claim 10 wherein the infrared camera is one that obtains thermal signatures in the 8–12 $\mu$m range.

12. A landmine detector as defined in claim 10 wherein the microwave source's output is at 2.45 GHz.

13. A method for detecting buried landmines comprising means for moving a vehicle over a soil surface where a buried landmine might exist, the vehicle having vertically oriented means to irradiate that soil surface with high-power microwaves, means for obtaining thermal images of an area of the soil surface that is being irradiated with microwaves as that surface is being irradiated and means for obtaining thermal images of said area for a period of time after it has been subjected to irradiation, said thermal images providing indications as to the possible presence of any landmines buried in that area.

14. A method for detecting buried landmines as defined in claim 13 wherein said means to irradiate that soil surface can irradiate the soil surface with a power density in the range of 1 to 3 $W/cm^2$.

15. A method for detecting buried landmines as defined in claim 14 wherein said means to irradiate that soil surface is operable at a variable power level up to 5 kW.

16. A method for detecting buried landmines as defined in claim 14 wherein said means for obtaining thermal images is an infrared camera that obtains thermal images in the 8–12 $\mu$m range.

17. A method for detecting buried landmines as defined in claim 15 wherein multiple thermal images are obtained during a period of time as long as 20 minutes after said area has been subjected to irradiation.

18. A method for detecting buried landmines as defined in claim 16 wherein multiple thermal images are obtained during a period of time as long as 20 minutes after said area has been subjected to irradiation.

19. A method for detecting buried landmines as defined in claim 15 wherein said means for obtaining thermal images is an infrared camera that obtains thermal images in the 8–12 $\mu$m range.

20. A method for detecting buried landmines as defined in claim 14 wherein multiple thermal images are obtained during a period of time as long as 20 minutes after said area has been subjected to irradiation.

* * * * *